US007131357B2

(12) United States Patent
Wolf

(10) Patent No.: US 7,131,357 B2
(45) Date of Patent: Nov. 7, 2006

(54) UNIVERSAL GOLF SPIKE REMOVAL TOOL

(76) Inventor: Jeffrey A. Wolf, 4161 Briarcliff Cir., Boca Raton, FL (US) 33496

( * ) Notice: Subject to any disclaimer, the term of this patent is extended or adjusted under 35 U.S.C. 154(b) by 166 days.

(21) Appl. No.: 10/886,839

(22) Filed: Jul. 8, 2004

(65) Prior Publication Data

US 2005/0005740 A1 Jan. 13, 2005

Related U.S. Application Data

(60) Provisional application No. 60/486,735, filed on Jul. 11, 2003.

(51) Int. Cl.
*B25B 23/00* (2006.01)
*B25B 23/08* (2006.01)
*B25G 1/08* (2006.01)

(52) U.S. Cl. ..... 81/437; 81/451; 81/461; 81/176.15

(58) Field of Classification Search ..... 81/437, 81/439, 441, 451, 124.4, 124.5, 176.15, 177.5, 81/461, 177.4
See application file for complete search history.

(56) References Cited

U.S. PATENT DOCUMENTS 76,900 A * 4/1868 Fisk ..... 81/176.15
1,140,947 A * 5/1915 Butler ..... 81/177.5
1,323,056 A * 11/1919 Hofmann ..... 81/124.5
2,750,821 A * 6/1956 Hilsinger ..... 81/441
3,412,635 A * 11/1968 Chmielewski ..... 81/176.15
4,262,562 A 4/1981 MacNeill
5,865,078 A 2/1999 Langford
5,875,694 A 3/1999 Graf
5,887,496 A 3/1999 Pollard et al.
5,950,508 A * 9/1999 Rossi ..... 81/451
6,053,078 A 4/2000 Parker et al.
6,161,456 A 12/2000 Langford
6,170,364 B1 1/2001 Johnson
6,272,953 B1 8/2001 Kant
6,877,403 B1 * 4/2005 Hsien ..... 81/124.5

* cited by examiner

*Primary Examiner*—Hadi Shakeri
(74) *Attorney, Agent, or Firm*—Gerald E. Hespos; Anthony J. Casella

(57) ABSTRACT

The golf spike removal tool includes a primary shank with opposite proximal and distal ends. A handle is secured to the proximal end of the primary shank and projections extend from the distal end of the primary shank for engaging apertures in a golf spike. A supplemental shank is telescoped relative to the primary shank and can be releasably engaged in either a first position or a second position with respect to the primary shank. The supplemental shank includes an array of sharply pointed teeth at the distal end thereof. The teeth project distally beyond the primary shank when the supplemental shank is in the distal position.

10 Claims, 5 Drawing Sheets

UNIVERSAL GOLF SPIKE REMOVAL TOOL

This application claims priority on U.S. Provisional Patent Appl. No. 60/486,735, filed Jul. 11, 2003.

BACKGROUND OF THE INVENTION

1. Field of the Invention

The subject invention relates to a tool for removing golf spikes from a golf shoe.

2. Description of the Related Art

Golf shoes include an array of spikes that are intended to hold the feet of a golfer stationary while the golfer completes his or her swing. The typical golf shoe has been formed with an array of threaded apertures that extend into the sole and into the heel. The typical golf spike has included a long metal projection that is sufficiently sharp to penetrate into the turf of the golf course. The projection has been formed unitarily with or mounted to a shank with an array of external threads configured for removable threaded engagement into the threaded apertures of the golf shoe. A disc-shaped base has extended outwardly between the pointed projection and the threaded shank. The disc is dimensioned and disposed for secure mounting adjacent the lower surface of the sole or heel when the shank is threaded into one of the apertures formed in the sole or heel.

Many golf courses now prohibit golf spikes with metal projections. Rather, most golf spikes now are formed entirely from plastic. The plastic golf spikes include a threaded plastic shank, a plastic disc adjacent the shank and a plastic projection or an array of plastic projections that extend from the disc in a direction opposite from the shank.

Golf spikes, and particularly the more recently used plastic golf spikes wear quickly and require replacement. A frequent golfer may change golf spikes several times during the course of a golfing season. Forces generated during normal wear of a golf shoe can deform the interengaged surfaces of the golf spike and the golf shoe sufficiently to complicate the threaded removal. As a result, a golfer typically must employ a tool to threadedly remove the golf spike. The golf spike removal process can be extremely difficult even with the benefit of a tool.

The typical golf spike includes a pair of diametrically opposed apertures that open to the lower face of the disc of the golf spike. The golf spike removal tool includes a pair of projections disposed and dimensioned to be received in the diametrically opposed apertures formed in the disc of the golf spike. The golfer inserts the projections of the tool into the apertures formed in the golf spike and then rotates the tool to remove the golf spike.

Golf spikes and golf shoes are manufactured by many different companies, and the respective companies have their own preferred arrangement for the holes formed in the disc of the golf spike. The differences relate to the sizes and shapes of the holes and the spacings between the holes. Thus, a tool may fit the apertures formed in one golf spike, but not in another. Some golf spike removal tools have a handle and a removable head. The golfer selects a head appropriate for the particular golf spikes on the golfer's shoes. The selected head then is mounted to the handle to permit removal of the golf spike.

The disc of the golf spike is formed from plastic, and hence the aperture for the golf spike removal tool extends into the plastic of the disc. Forces generated in an effort to remove a stubbornly wedged golf spike often will break or gouge the plastic near the apertures that are intended to accommodate the golf spike removal tool. Such damage to the disc can severely complicate the golf spike removal process and can render a conventional golf spike removal tool useless. The disc also can be damaged if the golfer inadvertently attempts removal with a tool that is not matched appropriately for the holes In the golf spike. In this regard, the differences between the apertures in the discs of different golf spikes often are fairly minor and might not be appreciated during the initial visual inspection of the golf spike. Hence, it is fairly common for a golfer to attempt removal with the wrong tool, thereby damaging the disc of the golf spike and substantially complicating the spike removal process. Golfers may resort to a conventional pair of pliers in an effort to remove a golf spike that has been damaged during an initial removal attempt. However, there are no good gripping surfaces on a golf spike and attempts to unthread a golf spike with a pair of pliers will seldom work.

In view of the above, it is an object of the subject invention to provide a golf spike removal tool that can be used with all golf spikes and that is effective for removing golf spikes where the spike has become interengaged very tightly in the golf shoe.

SUMMARY OF THE INVENTION

The subject invention relates to a universal golf spike tool having an elongate primary shank with proximal and distal ends. A handle is securely mounted to the proximal end of the primary shank and is configured for secure gripping by the golfer. The distal end of the primary shank has a pair of projections dimensioned for engagement in the apertures formed in a large number of golf spikes. Thus, the projections at the distal end of the primary shank can be used for engaging and removing a substantial number of commercially available golf spikes. However, the projections at the distal end of the primary shank will not fit all golf spikes. Additionally, some golf spikes may be worn sufficiently through usage to prevent the projections from being effective. In still other instances, the golf spike may be engaged so tightly that the projections will damage portions of the disc adjacent the apertures during efforts to remove the golf spike.

The tool of the subject invention further includes a supplemental shank that is telescoped relative to the primary shank. The supplemental shank has a distal end with plurality of projections that are sufficiently pointed to bite into the plastic disc of the golf spike. Thus, the pointed projections of the supplemental shank can be embedded into the plastic of the disc of the golf spike to effect removal of the golf spike in those situations where the projections at the distal end of the primary shank do not fit the apertures in the golf spike or where the golf spike has been too damaged to receive the projections at the distal end of the primary shank.

The primary shank preferably is hollow and the supplemental shank preferably is telescoped within the primary shank. Thus, the supplemental shank can be telescoped from a proximal position where the distal end of the entire supplemental shank is within the primary shank to a distal position where the supplemental shank projects distally beyond the primary shank. The primary and supplemental shanks may have cooperating means for keeping the supplemental shank either in a proximal position or in a distal position. For example, the primary shank may be formed with a generally J-shaped groove or a stepped groove, and the supplemental shank may be formed with a locking but that project through the J-shaped groove. Thus, the supplemental shank can be locked either in a proximal position or a distal position. The locking of the supplemental shank in the proximal position enables a golf spike removal effort to be undertaken using only the rigid projections at the distal end of the primary shank. The locking of the supplemental shank in the distal position enables a golf spike removal effort to be undertaken using the pointed projections at the distal end of the supplemental shank.

The tool of the subject invention also may include biasing means for biasing the supplemental shank either in a proximal direction or in a distal direction. In a preferred embodiment, the biasing means will be configured for urging the supplemental shank in the proximal direction. Thus, the tool is biased into a configuration where the sharply pointed projections of the supplemental shank are withdrawn. However, sufficient force on the supplemental shank will overcome the biasing forces exerted on the supplemental shank and will permit the supplemental shank to be locked in its distal position.

The tool of the subject invention can include an alternate arrangement of tips that can be telescoped into engagement with the rigid tips that project from the distal end of the primary shank. The alternate tips can be dimensioned and configured to enable the primary shank to be used with a larger number of commercially available golf spikes. In these situations, the supplemental shank will be used primarily in those situations where the golf spike has been damaged or wedged in the golf shoe.

The tool may have an overall T-shape with the handle extending transversely from the proximal end of the primary shank. The handle may be solid. Alternatively, the handle may be hollow and may be used to store a related tool, such as a brush for cleaning the spikes of the golf shoe.

DETAILED DESCRIPTION OF THE PREFERRED EMBODIMENT

Figure 1:
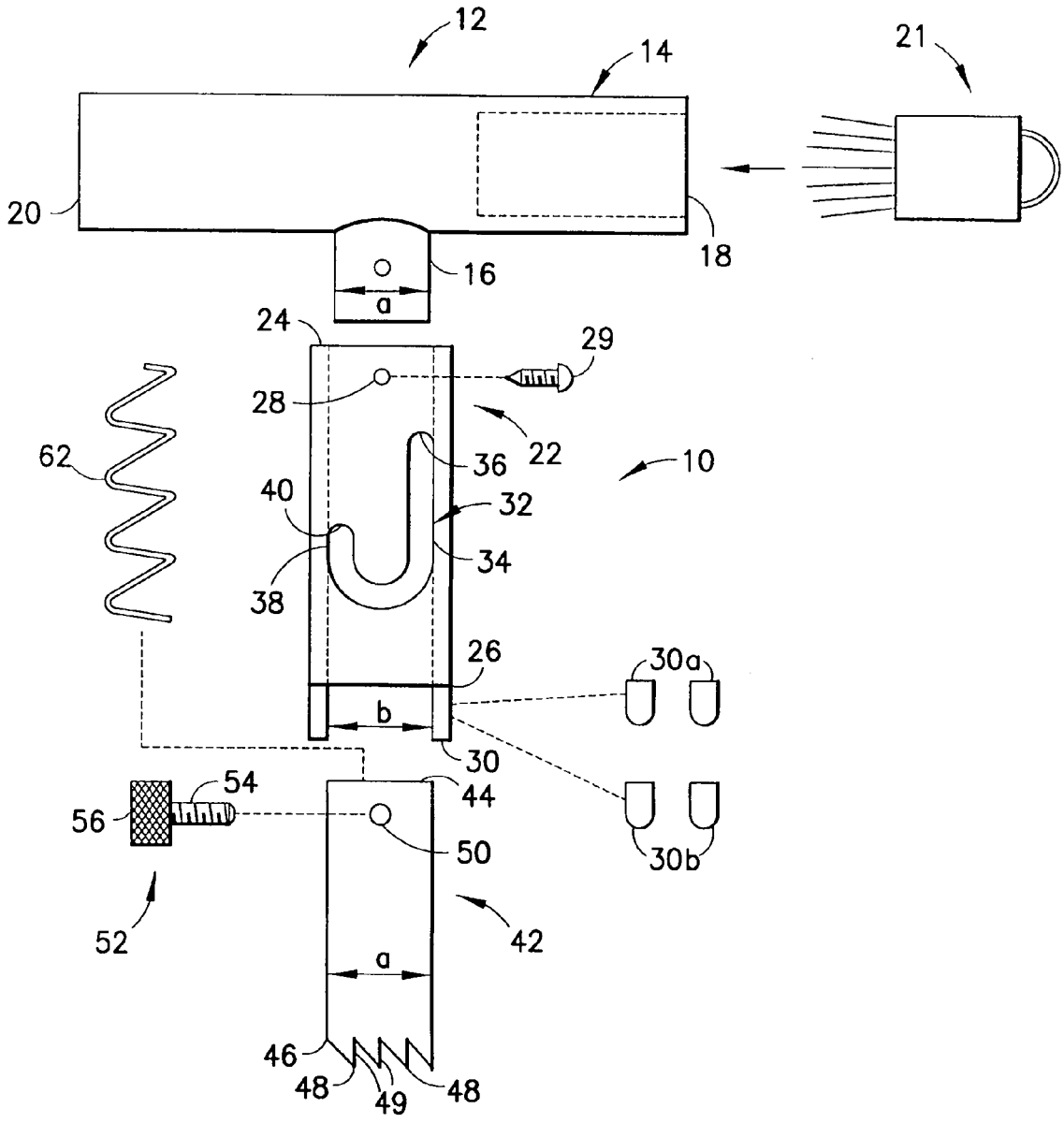
FIG. 1 is an exploded side elevational view of a golf spike removal tool in accordance with the subject invention.
Figure 2:
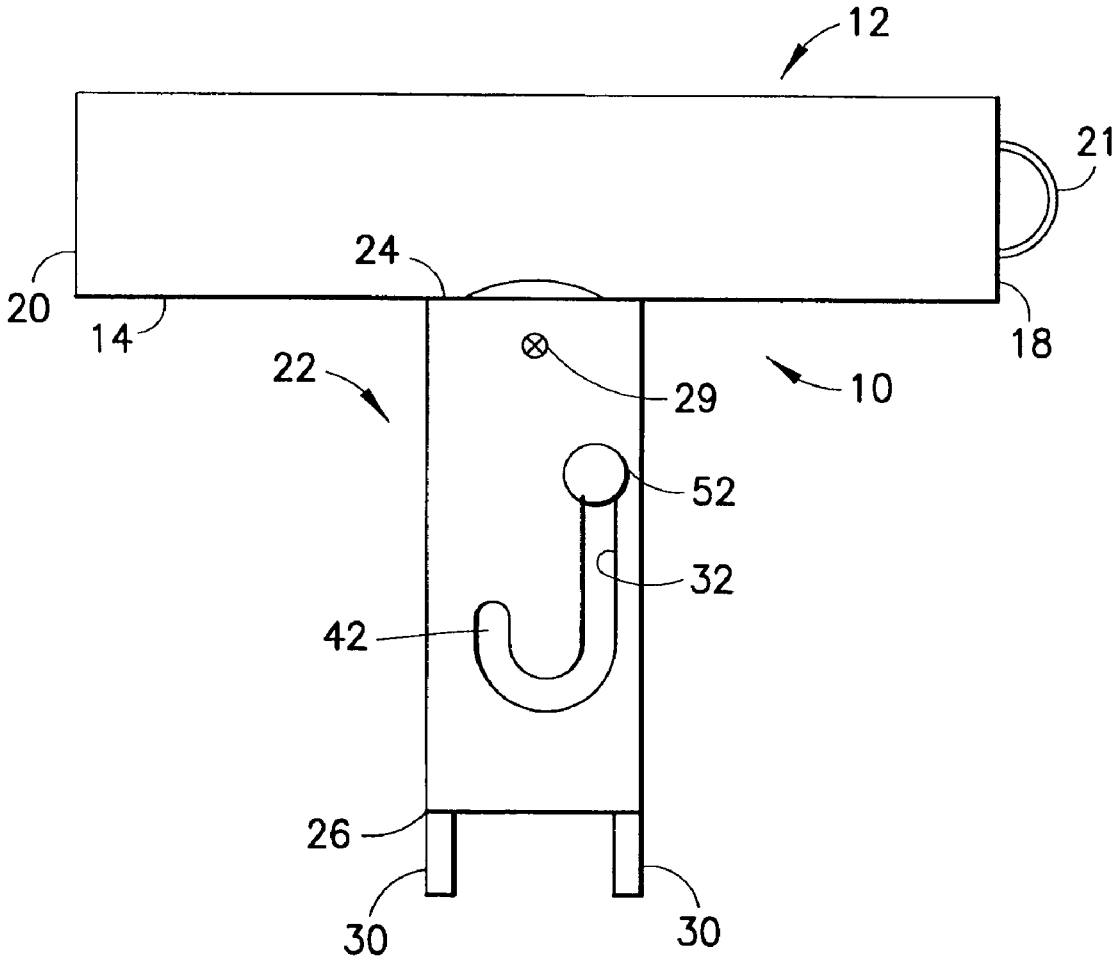
FIG. 2 is a side elevational view of the assembled components of the tool with the supplemental shank in the proximal and retracted position.
Figure 3:
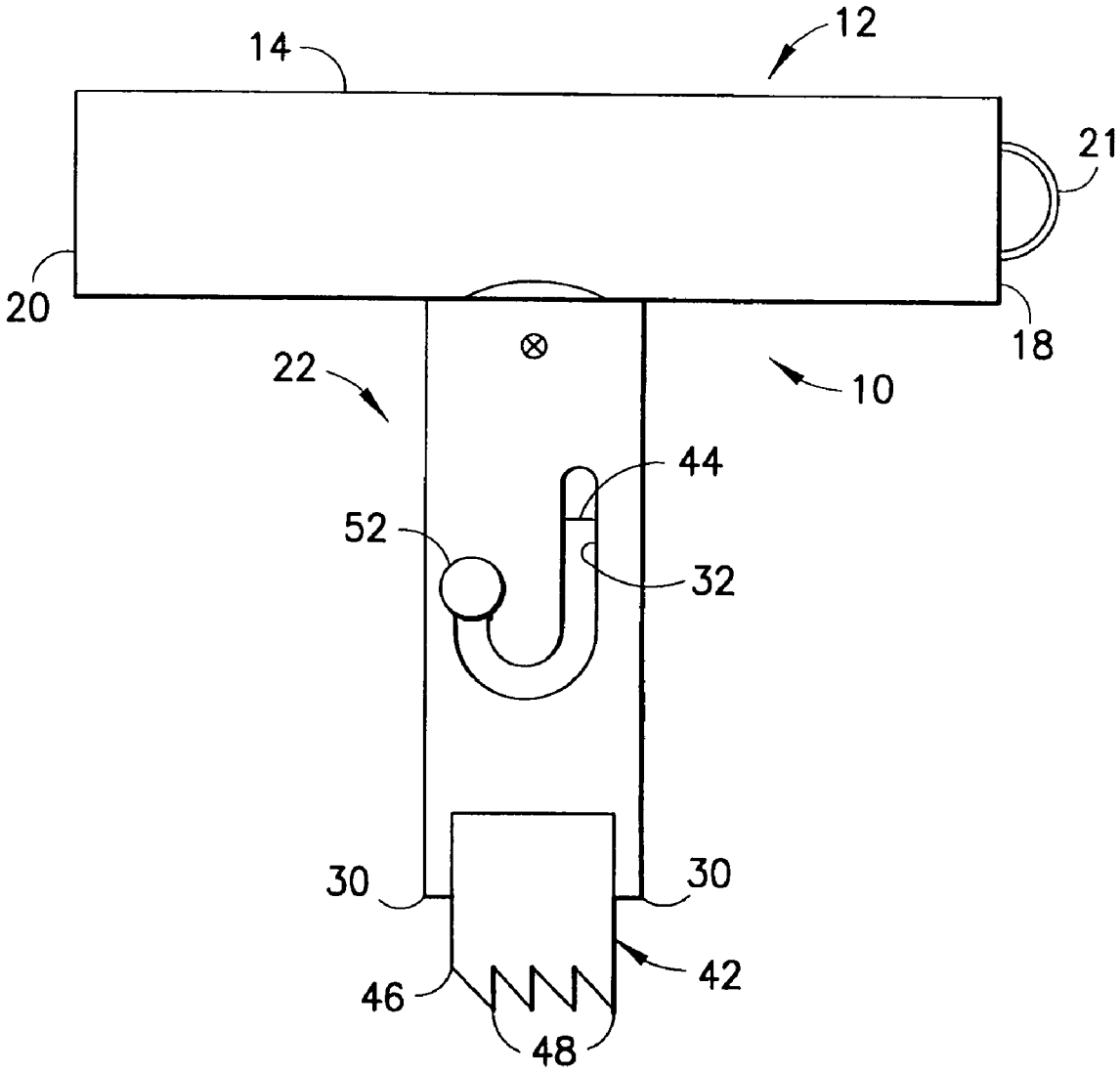
FIG. 3 is a side elevational view of the golf spike removal tool with the supplemental shank in the distal and extended position.
Figure 4:
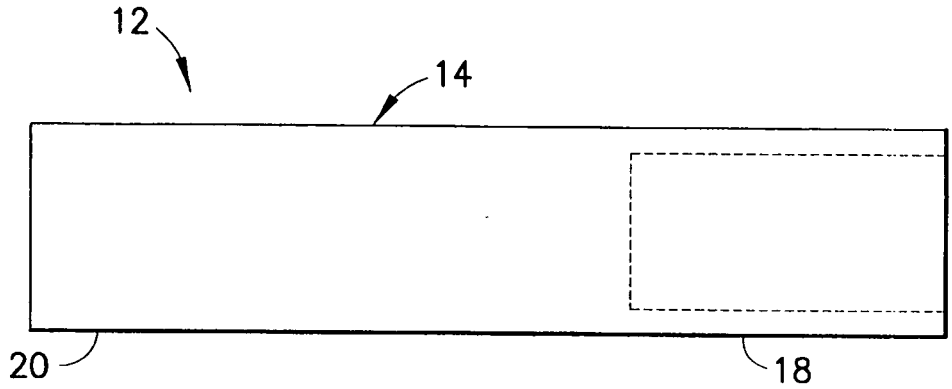
FIG. 4 is a top plan view of the handle of the spike removal tool shown in FIGS. 1–3.
Figure 5:
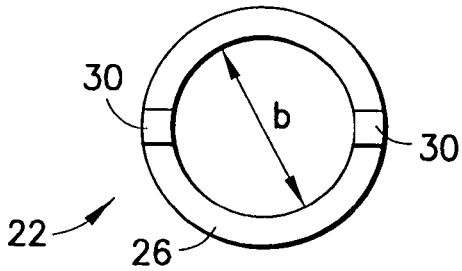
FIG. 5 is a bottom plan view of the primary shank.
Figure 6:
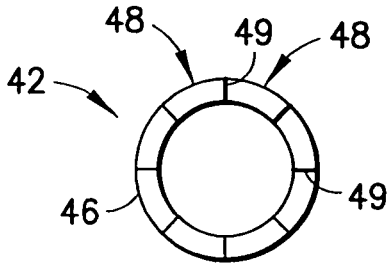
FIG. 6 is a bottom plan view of the supplemental shank.
Figure 7:
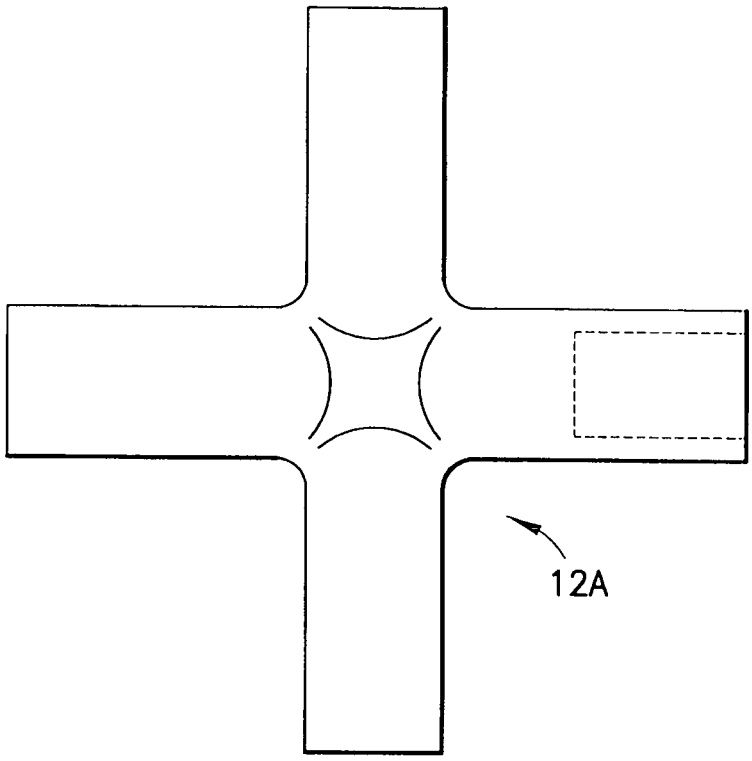
FIG. 7 is a top plan view of an alternate handle.

A golf spike removal tool in accordance with the subject invention is identified generally by the numeral 10 in FIGS. 1–3. The tool 10 includes a rigid handle 12 with a grip 14 and a mounting stub 16, and shown in FIGS. 1–4. The grip 14 of the handle 12 is illustrated as being substantially cylindrical with opposite first and second ends 18 and 20. However, variations from a purely cylindrical shape are possible and may be preferable in certain situations. For example, narrowed regions to facilitate gripping can be provided at locations between the first and second ends 18 and 20. Alternatively, a cross-shaped handle 12A can be provided, as shown in FIG. 7. The handle 12 shown in FIGS. 1–4 may be molded from a rigid and substantially solid plastic or metal material with sufficient strength to withstand the torque imposed upon the tool 10 during the removal of a golf spike. However, the handle 12 can be formed from a hollow plastic or metal material if the walls are sufficiently thick to give the necessary strength to the tool 10 for applying the torque to the golf spike. In the illustrated embodiment, the grip 14 of the handle 12 is substantially hollow and is open at the first end 18 thereof. In this embodiment, a supplemental tool, such as the brush 21 illustrated in FIG. 1 can be mounted into the open first end 18 of the hollow gripping section 14. The brush 21 is useful for removing dirt and other debris from golf spikes.

The mounting section 16 of the handle 12 extends from a location substantially centrally between the first and second ends 18 and 20 of the grip 14 and defines a short rigid stub with an outside diameter "a". The mounting stub 16 preferably is formed unitarily with the grip 14.

The tool 10 further includes a primary shank 22, as shown in FIGS. 1–3 and 5. The primary shank 22 is a hollow cylindrical member formed from a metallic material and having an inside diameter "b" which is slightly greater than the outside diameter "a" of the mounting section 16 of the handle 12. More particularly, the primary shank 22 includes an open proximal end 24 and an open distal end 26. The inside diameter "b" permits the mounting stub 16 of the handle 12 to be telescoped into the open proximal end 24 of the primary shank 22. Portions of the primary shank 22 near the proximal end 24 are formed with a threaded aperture 28 that is aligned radially. The aperture 28 is in a position that will align with the mounting stub 16 of the handle 12 when the mounting stub 16 is telescoped into the open proximal end 24 of the primary shank 22. A mounting screw 29 is threadedly engaged in the aperture 28 and is securely engaged in the mounting stub 16 of the handle 12 to hold the handle 12 securely and substantially permanently to the proximal end 24 of the primary shank 22.

The distal end 26 of the primary shank 22 is characterized by diametrically opposed projections 30. The projections 30 are disposed and dimensioned to telescope into the apertures formed in the disc of a commercially available golf spike. Thus, the projections 30 at the distal end 26 of the primary shank 22 can be used to threadedly disengage some golf spikes from a golf shoe.

As noted above, there are many different types of golf spikes with removal apertures of different sizes, shapes and positions. The golf spike removal tool 10 of the subject invention preferably includes supplemental tips 30*a* and 30*b*. The supplemental tips 30*a* and 30*b* include mounting apertures (not shown) in one end that are dimensioned to be telescoped tightly over the projections 30 at the distal end 26 of the primary shank 22. However, external dimensions of the supplemental tips 30*a* and 30*b* are different from one another and different from the projections 30. Thus, the supplemental tips 30*a* and 30*b* can be removably engaged over the projections to adapt the tool 10 to a particular golf spike.

Figure 8:
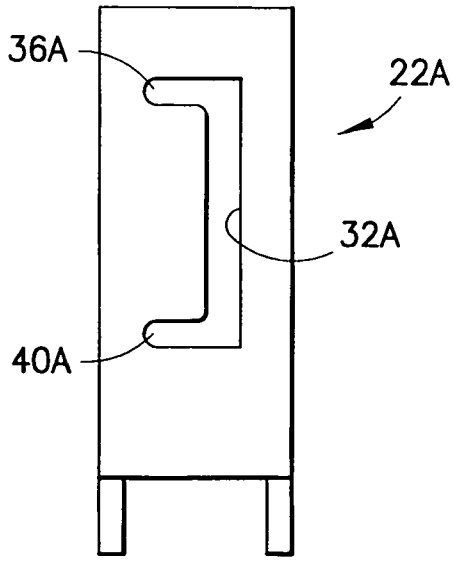
FIG. 8 is a side elevational view of an alternate primary shank.

Portions of the primary shank 22 between the proximal and distal ends 24 and 26 are provided with a J-shaped cut-out 32. The J-shaped cut-out 32 includes a long leg 34 with a proximal end 36 and a short leg 38 with a proximal end 40. The distance between the proximal end 24 of the primary shank 22 and the proximal end 36 of the long leg 34 of the J-shaped cut-out 32 is less than the distance between the proximal end 24 of the primary shank 22 and the proximal end 40 of the shorter leg 38. The cut-out can take other forms. For example, FIG. 8 shows an alternate primary shank 22A with a C-shaped cut-out 32A. The cut-out 32A has proximal and distal legs 36A and 40A.

The tool 10 further includes a supplemental shank 42, as shown in FIGS. 1–3. The supplemental shank 42 is a generally cylindrical tube formed from a metal material and has a proximal end 44 and a distal end 46. The supplemental shank 42 is shorter than the primary shank 22. Additionally, the supplemental shank 42 defines an outside diameter "a" that is approximately equal to the outside diameter "a" of the mounting section 16 of the handle 12.

The distal end 46 of the supplemental shank 42 is characterized by a plurality of sharply pointed projections 48. Each projection 48 preferably has an axially aligned edge 49 disposed on the counterclockwise face of the projection 48 when viewed in a proximal-to-distal direction. Thus, the axially aligned edge 49 is effective for unthreading a golf spike as explained further herein. The supplemental shank 42 further includes a threaded aperture 50 at a location between proximal and distal ends 44 and 46.

The tool 10 further includes a locking bolt 52. The locking bolt 52 has a threaded shaft 54 at one end and a knarled head 56 at the opposed end. The threaded shaft 54 is dimensioned to pass through the J-shaped cut-out 32 in the primary shank and to threadedly engage in the aperture 50 of the supplemental shank 42.

The illustrated embodiment of FIG. 1 shows an optional coil spring 62 within the primary shank 22. One end of the coil spring 62 is connected to the mounting stub 16 of the handle 12 while the opposed end is connected to the supplemental shank 42. The coil spring functions to bias the supplemental shank 42 toward the handle 12.

The tool 10 is assembled by telescoping the mounting stub 16 of the handle 12 into the open proximal end 24 of the primary shank 22. The screw 29 then is threaded through the aperture 28 in the primary shank 22 and is attached securely to the mounting section 16 to hold the primary shank 22 to the handle 12. The proximal end 44 of the supplemental shank 42 then is telescoped in a distal-to-proximal direction into the open distal end 26 of the primary shank 22. The supplemental shank 42 is moved into a position where the threaded aperture 50 in the supplemental shank 42 aligns with a portion of the J-shaped cut-out 32 in the primary shank 22. The threaded shaft 54 of the locking bolt 52 then is passed through the J-shaped cut-out 32 and is threadedly engaged in the aperture 50 of the supplemental shank 42. The tool 10 then may be packaged and sold in this assembled condition.

The locking bolt 52 can be tightened and loosened selectively against the outer circumferential surface of the primary shank 22 at locations near the J-shaped cut-out 32. More particularly, the locking bolt 52 can be used to secure the supplemental shank 52 in a proximal position with the locking bolt 52 tightened at a location near the proximal end 36 of the long leg 34 of the J-shaped cut-out 32. In this position, the pointed projections 48 at the distal end 46 of the supplemental shank 42 are retracted within the primary shank 22. Alternatively, the locking bolt 52 can be loosened to move the supplemental shank 42 distally in the primary shank 22 and into a distal position. In the distal position, the locking bolt 52 is substantially adjacent the proximal end 40 of the short leg 38 of the J-shaped cut-out 32. In this position, the pointed projections 48 at the distal end 46 of the supplemental shank 42 project distally beyond the projections 30 at the distal end 26 of the primary shank 22.

The tool 10 can be used by initially attempting a golf spike removal with the supplemental shank 42 in the proximal position and retracted into the primary shank 22. In some situations, the projections 30 at the distal end 26 of the primary shank 22 will not fit the removal apertures in the golf spike. In other situations, the golf spike will be sufficiently worn to prevent engagement of the projections 30 with the removal apertures. In still other situations, the golf spike will be wedged into the golf shoe and an initial attempt at removal will damage the golf spike sufficiently to impede the effectiveness of the projections 30. In any of these situations, the locking bolt 52 is loosened and the supplemental shank 42 is moved into the distal position. The locking bolt 52 then is retightened adjacent the proximal end 40 of the short leg 38 of the J-shaped cut-out 32. This loosening, movement and tightening of the locking bolt 52 can be carried out easily by gripping the large knarled head 56 of the locking bolt 52 between a thumb and forefinger. In this distal position, the projections 48 at the distal end 46 of the supplemental shank 42 project distally beyond the projections 30 at the distal end 26 of the primary shank 22. The golfer can urge the pointed projections 48 into the plastic material of the disc on the damaged or wedged golf spike. The golfer then applies torque to the grip 14 of the handle 12 for removing the damaged or wedged spike.

While the invention has been described with respect to a preferred embodiment, it is apparent that various changes can be made without departing from the scope of the invention as defined by the appended claims. For example, the projections 30 at the distal end of the primary shank 22 can take many other configurations depending upon the specific shapes of the removal apertures in a golf spike that represents a major portion of the local market share. Similarly, the shapes of the points 48 at the distal end 46 of the supplemental shank 42 can take many other shapes, including a symmetrical point or a plural point projection.

What is claimed is:

1. A golf spike tool having a substantially tubular primary shank with opposite proximal and distal ends, a handle connected to the proximal end of the primary shank, two diametrically opposed projections formed at the distal end of the primary shank and configured for engaging recesses in a golf spike, a supplemental shank telescoped in the primary shank, the supplemental shank having a proximal end and a substantially tubular distal ends and being movable relative to the primary shank from a proximal position to a distal position, the distal end of the supplemental shank being disposed proximally of the projections at the distal end of the primary shank when the supplemental shank is in the proximal position, the distal end of the supplemental shank projecting distally beyond the projections of the primary shank when the supplemental shank is in the distal position, the distal end of the supplemental shank being formed with an array of pointed projections for biting into and engaging a plastic golf spike, the pointed projections at the distal end of the supplemental shank being disposed in a substantially circular array at the distal end of the supplemental shank, each of said pointed projections at said distal end of said supplemental shank having one edge aligned substantially parallel to a longitudinal axis of said supplemental shank, said edge being at a leading end of each of said pointed projection with respect to a rotational direction of said golf spike removal tool for removing a golf spike that cannot be removed by engaging the projections of the primary shank in the recesses of the golf spike.

2. The golf spike removal tool of claim 1, further comprising a lock for releasably locking the supplemental shank in at least one of the proximal and distal positions.

3. The golf spike removal tool of claim 2, wherein the lock comprises a slot formed in the primary shank and a locking bolt passed through the slot of the primary shank and threadedly engaged with the supplemental shank.

4. The golf spike removal tool of claim 3, wherein the slot in the primary shank is non-linear and includes at least one transversely extending section.

5. The golf spike removal tool of claim 4, wherein the slot is substantially J-shaped.

6. The golf spike removal tool of claim 4, wherein the slot is substantially C-shaped.

7. The golf spike removal tool of claim 1, wherein at least the distal end of the supplemental shank is substantially cylindrically tubular.

8. The golf spike removal tool of claim 1, further comprising a spring for biasing the supplemental shank to the proximal position.

9. The golf spike removal tool of claim 1, wherein the handle includes at least one transverse grip extending substantially transverse to a longitudinal axis extending between said proximal and distal ends of said primary shank.

10. The golf spike removal tool of claim 1, wherein the primary and supplemental shanks are formed from metal.

* * * * *